US008123539B2

(12) United States Patent
Nakamura et al.

(10) Patent No.: US 8,123,539 B2
(45) Date of Patent: Feb. 28, 2012

(54) CONNECTOR

(75) Inventors: Akio Nakamura, Shinagawa (JP); Takashi Yuba, Shinagawa (JP); Keiichi Hirose, Minato (JP); Tomonori Iino, Minato (JP)

(73) Assignees: Fujitsu Component Limited, Tokyo (JP); NTT Facilities, Inc., Tokyo (JP)

( * ) Notice: Subject to any disclaimer, the term of this patent is extended or adjusted under 35 U.S.C. 154(b) by 63 days.

(21) Appl. No.: 12/478,925

(22) Filed: Jun. 5, 2009

(65) Prior Publication Data

US 2010/0029141 A1 Feb. 4, 2010

(30) Foreign Application Priority Data

Jul. 30, 2008 (JP) ..... 2008-196923

(51) Int. Cl.
*H01R 29/00* (2006.01)

(52) U.S. Cl. ..... 439/188

(58) Field of Classification Search ..... 439/188, 439/371, 145, 137, 136; 200/51.09
See application file for complete search history.

(56) References Cited

U.S. PATENT DOCUMENTS 3,843,854 A * 10/1974 Mori et al. ..... 200/51.09
5,454,729 A * 10/1995 Wen-Te ..... 439/357
6,273,756 B1 * 8/2001 Ward et al. ..... 439/607.41
7,284,997 B2 * 10/2007 Joist ..... 439/157
2002/0079993 A1 * 6/2002 Toepfer ..... 335/18

FOREIGN PATENT DOCUMENTS

| | | |
|---|---|---|
| CN | 1275252 | 11/2000 |
| DE | 83 08 409 U1 | 6/1983 |
| JP | 05-082208 A | 4/1993 |
| JP | 2003-031310 A | 1/2003 |
| WO | WO 99/16154 A | 4/1999 |

OTHER PUBLICATIONS

Extended European Search Report.
Office Action dated Jan. 27, 2011 issued with respect to the corresponding Chinese Patent Application No. 200910151896.2.

* cited by examiner

*Primary Examiner* — Alexander Gilman
(74) *Attorney, Agent, or Firm* — IPUSA, PLLC

(57) ABSTRACT

A female connector for supplying received power has a recess, terminals including power terminals for supplying the power, a locking mechanism to lock a male connector that is inserted into the recess in a mated state in response to insertion of the male connector into the recess, and a switching mechanism to supply the received power to the power terminals in an ON state and to insulate the power terminals from the received power in an OFF state. The switching mechanism is permitted to make a transition to the ON state only when the locking mechanism is locking the male connector in the mated state.

22 Claims, 9 Drawing Sheets

CONNECTOR

BACKGROUND OF THE INVENTION

1. Field of the Invention

The present invention generally relates to connectors, and more particularly to a connector that is suited for supplying power, and to a combination of male and female connectors.

2. Description of the Related Art

Generally, an electronic apparatus needs to receive power from a power supply in order to perform an operation. Usually, the power from the power supply is supplied to the electronic apparatus via connectors. The connectors that are used to make the electrical connection include a male connector and a female connector that are designed to mate. Examples of such connectors are proposed in Japanese Laid-Open Patent Publications No. 5-82208 and No. 2003-31310, for example.

On the other hand, as a countermeasure against global warming, power transmissions in local areas using high DC voltages are being studied. According to such power transmissions, the power loss during the voltage transformation and power transmission is small, and it is unnecessary to increase the cross sectional size of cables. In information processing apparatuses, such as servers, which have a large power consumption, it is desirable to make the power supply according to such a power transmission.

But when supplying power to the electronic apparatus, there may be undesirable effects on the human body and on the electronic parts if the power is supplied in the form of a high voltage.

In addition, in the case of the electronic apparatus, such as the server, which receives the power in the form of the high voltage, the setup or maintenance of the electronic apparatus is attended to by a service person or maintenance person. Hence, as a safety measure, the connectors used in such an electronic apparatus for making the necessary electrical connections are configured differently from the connectors that are generally used for receiving power from a commercial power supply outlet.

SUMMARY OF THE INVENTION

Accordingly, it is a general object of one aspect of the present invention to provide a novel and useful connector and a combination of male and female connectors, in which the problems described above are suppressed.

Another and more specific object of one aspect of the present invention is to provide a connector and a combination of male and female connectors, which can safely transmit power in a form of a high voltage.

According to one aspect of the present invention, there is provided a female connector for supplying received power, comprising a recess configured to receive a male connector; a plurality of terminals including power terminals for supplying the power; a locking mechanism configured to lock the male connector that is inserted into the recess in a mated state in response to insertion of the male connector into the recess; and a switching mechanism configured to supply the received power to the power terminals in an ON state and to insulate the power terminals from the received power in an OFF state, wherein the switching mechanism is permitted to make a transition to the ON state only when the locking mechanism is locking the male connector in the mated state.

According to another aspect of the present invention, there is provided a combination of a male connector and a female connector, said combination comprising a male connector comprising first terminals; and a female connector comprising a recess configured to receive the male connector; a plurality of second terminals including power terminals for supplying received power; a locking mechanism configured to lock the male connector that is inserted into the recess in a mated state in response to insertion of the male connector into the recess; and a switching mechanism configured to supply the received power to the power terminals in an ON state and to insulate the power terminals from the received power in an OFF state, wherein the switching mechanism is permitted to make a transition to the ON state only when the locking mechanism is locking the male connector in the mated state.

Other objects and further features of various aspects the present invention will be apparent from the following detailed description when read in conjunction with the accompanying drawings.

DESCRIPTION OF THE PREFERRED EMBODIMENTS

Figure 1:
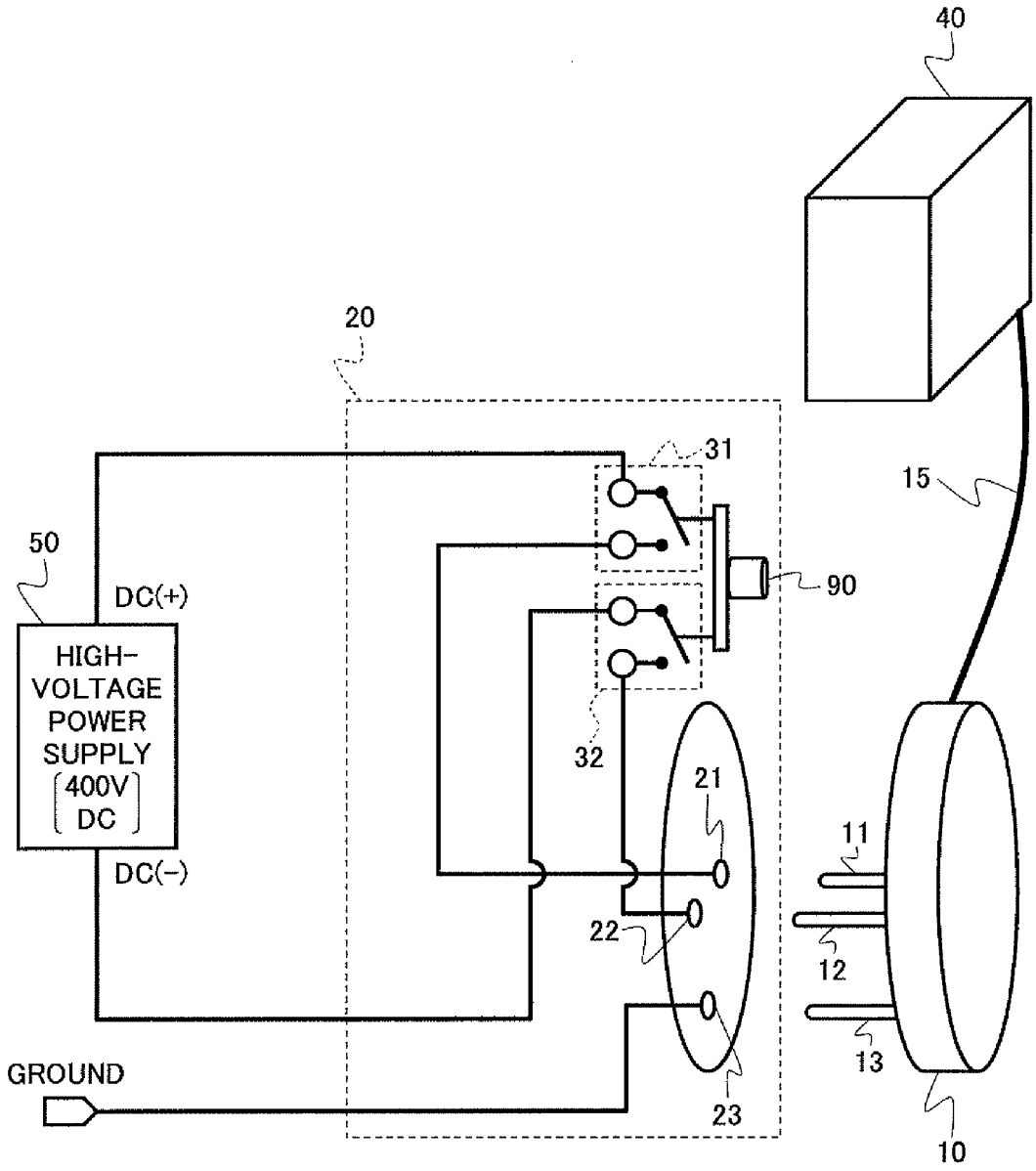
FIG. 1 is a diagram for explaining electrical connections of connectors in a first embodiment of the present invention.

A description will be given of embodiments of a connector and a combination of male and female connectors according to the present invention, by referring to the drawings.

FIG. 1 is a diagram for explaining electrical connections or electrical couplings of connectors in a first embodiment of the present invention.

In this embodiment, the combination of male and female connectors include a male connector 10 and a female connector 20. The male connector 10 is connected to an information processing apparatus 40, such as a server and a computer, via a power cable 15. The male connector 10 includes two power plug terminals 11 and 12 for receiving power, and a ground plug terminal 13 for grounding.

On the other hand, the female connector 20 is connected to a high-voltage power supply 50 for supplying power. The female connector 20 includes power jack terminals 21 and 22 which correspond to the power plug terminals 11 and 12, and a ground jack terminal 23 which corresponds to the ground plug terminal 13. The female connector 20 further includes two control switches 31 and 32. For example, the control switches 31 and 32 are respectively formed by a leaf spring switch or the like which permits a current to flow when a moving contact makes contact with a fixed contact. An abutting switch 90 controls the connection state of the control switches 31 and 32. When the abutting switch 90 is pushed, the moving contact makes contact with the fixed contact in each of the control switches 31 and 32.

A first fixed contact of the control switch 31, which is connected to the moving contact, is connected to a positive polarity output of the high-voltage power supply 50. A second fixed contact of the control switch 31 is connected to the power jack terminal 21. A first fixed contact of the control switch 32, which is connected to the moving contact, is connected to a negative polarity output of the high-voltage power supply 50. A second fixed contact of the control switch 32 is connected to the power jack terminal 22.

Of course, in each of the control switches 31 and 32, the moving contact may be fixed to the second fixed contact so that the moving contact is controlled to make contact with the first fixed contact.

When the moving contact makes contact with the second fixed contact in each of the control switches 31 and 32, the power is supplied to the power jack terminals 21 and 22 of the female connector 20. In this state, when the male connector 10 is connected to the female connector 20, the power is supplied from the power jack terminals 21 and 22 of the female connector 20 to the corresponding power plug terminals 11 and 12 of the male connector 10, and the power is consequently supplied to the information processing apparatus 40 via the male connector 10 and the power cable 15.

In this embodiment, the control switches 31 and 32 are provided with respect to the power jack terminals 21 and 22 in order to improve safety. If the high voltage supplied from the high-voltage power supply 50 exceeds 48 V, and particularly if a DC high-voltage of 200 V or higher is supplied from the high-voltage power supply 50, there may be undesirable effects on the human body when a person touches the power jack terminals 21 and 22 which is supplying the high-voltage. For example, the high-voltage supplied from the high-voltage power supply 50 may be a DC high-voltage of 400 V. But by providing the abutting switch 90 which controls the connection state of the control switches 31 and 32, it is possible to control the timing when the power jack terminals 21 and 22 are to supply the high-voltage.

Figure 2A:
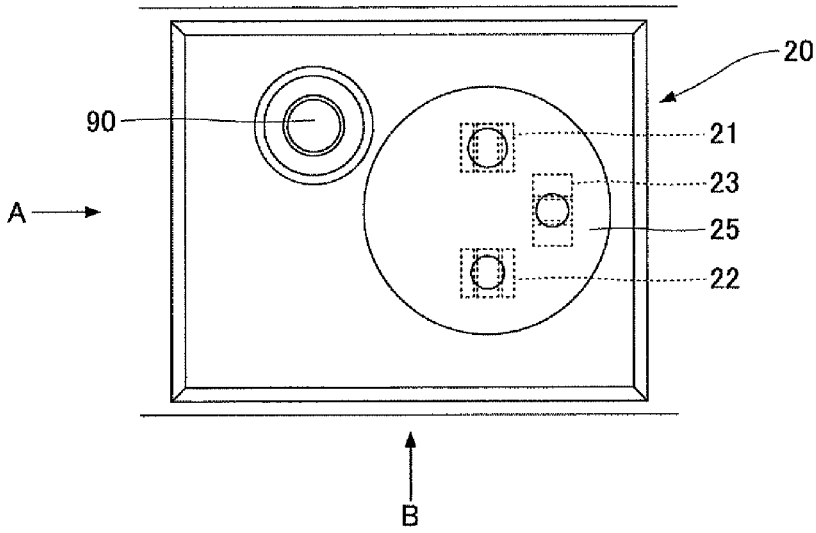
FIGS. 2A, 2B and 2C are diagrams, in partial transparency, showing a structure of a female connector in the first embodiment.
Figure 2B:
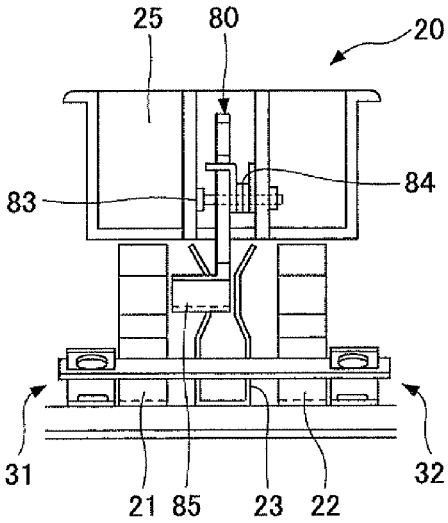
Figure 2C:
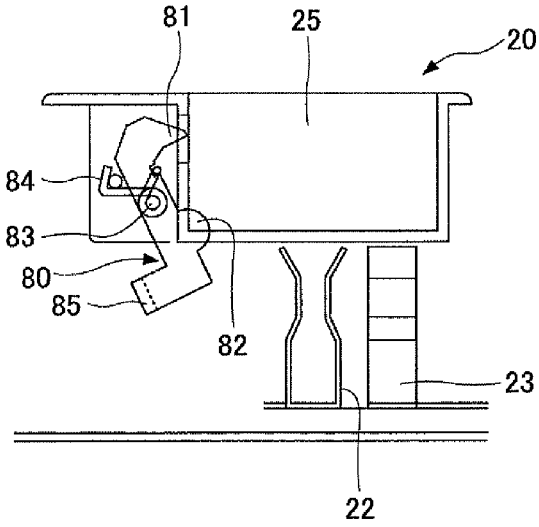

FIGS. 2A, 2B and 2C are diagrams, in partial transparency, showing a structure of the female connector 20 in the first embodiment. FIG. 2A is a top view of the female connector 20. FIG. 2B is a front view, in partial transparency, showing the female connector 20 viewed in a direction A in FIG. 2A, and FIG. 2C is a side view, in partial transparency, showing the female connector 20 viewed in a direction B in FIG. 2A.

The female connector 20 in this embodiment has a recess 25 into which the male connector 10 can be inserted, as will be described later. The power jack terminals 21 and 22 and the ground jack terminals 23 are provided at the bottom of the recess 25, that is, at a bottom surface defining the bottom of the recess 25. As described above, the first contact of the control switch 31 is connected to the high-voltage power supply 50, and the second contact of the control switch 31 is connected to the power jack terminal 21. On the other hand, the first contact of the control switch 32 is connected to the high-voltage power supply 50, and the second contact of the control switch 32 is connected to the power jack terminal 22.

A releasable lock 80 is provided on a side surface of the recess 25 (or a skirt portion forming the recess 25) of the female connector 20. The releasable lock 80 has a claw part 81 provided on one end thereof, and a circular projection 82 provided on the other end thereof. The releasable lock 80 has a rotary shaft 83 provided in a central part thereof, and the releasable lock 80 is linked to the female connector 20 via the rotary shaft 83. Hence, the releasable lock 80 is pivotable about the rotary shaft 83. A compression spring 84 is loaded on the rotary shaft 83, so that the circular projection 82 projects into the recess 25 of the female connector 20 from the side surface of the recess 25 in a state where the male connector 10 is not inserted into the recess 25 of the female connector 20. In addition, a stopper 85 is provided on the other end of the releasable lock 80 provided with the circular projection 82. The stopper 85 is formed by an L-shaped projecting part extending approximately parallel to the rotary shaft 83. A more detailed description of the stopper 85 will be given later in the specification.

The releasable lock 80, the claw part 81, the circular projection 82, the rotary shaft 83, the compression spring 84, and the stopper 85 form a locking mechanism.

Figure 3A:
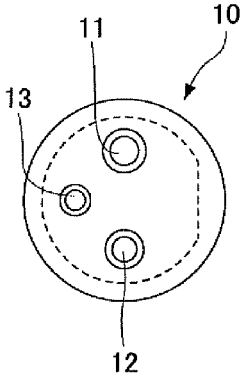
FIGS. 3A, 3B, 3C, 3D, and 3E are diagrams showing a structure of a male connector in the first embodiment.
Figure 3B:
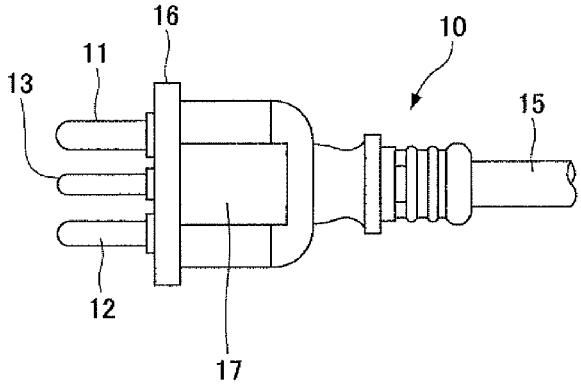
Figure 3C:
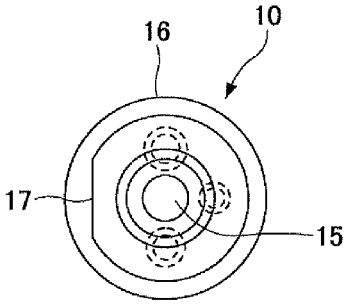

Next, a description will be given of the male connector 10 of this embodiment, by referring to FIGS. 3A through 3E. FIGS. 3A, 3B, 3C, 3D, and 3E are diagrams showing a structure of the male connector 10 in the first embodiment. FIG. 3A shows a bottom view of the male connector 10, FIG. 3B shows a front view of the male connector 10, and FIG. 3C shows a top view of the male connector 10.

The male connector 10 of this embodiment has a flange 16, and the power plug terminals 11 and 12 and the ground plug terminal 13 are provided on the flange 16. A main body of the male connector 10 is connected to the power cable 15, and the main body has a locking part 17. A portion of the main body is removed along a direction in which the male connector 10 is inserted into the recess 25 of the female connector 20, in order to form the locking part 17. As will be described later, the flange 16 has a function of turning the releasable lock 80 of the female connector 20 in order to lock the male connector 10 and the female connector 20 in a mated state, and a function of improving insulation with respect to the human body when a person inserts the male connector 10 into the female connector 20 or removes the male connector 10 from the female connector 20.

Figure 3D:
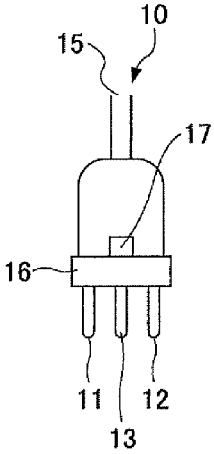
Figure 3E:
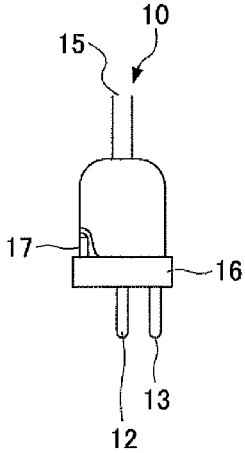

The structure of the locking part 17 of the male connector 10 in this embodiment is not limited to that shown in FIGS. 3B and 3C, and may have a modified structure shown in FIGS. 3D and 3F, for example. FIG. 3D shows a front view of the male connector 10 having the locking part 17 having the modified structure, and FIG. 3E is a side view of the male connector 10 shown in FIG. 3D.

In this embodiment, it is assumed for the sake of convenience that the power plug terminals 11 and 12 and the ground plug terminal 13 have a cylindrical shape, however, the plug terminals 11 through 13 may have other suitable shapes, such as a blade shape. Of course, the plug terminals 11 through 13 do not need to have identical shapes, and at least one of the plug terminals 11 through 13 may have a shape different from that of the other two of the plug terminals 11 through 13. In addition, the cross sectional area of the plug terminals 11 and 12 may be different from that of the plug terminal 13. For example, the cross sectional area of the plug terminals 11 and 12 may be larger than that of the plug terminal 13. The different plug shape and/or size can prevent the male connector 10 from being inserted into the female connector 20 in an incorrect orientation.

Figure 4:
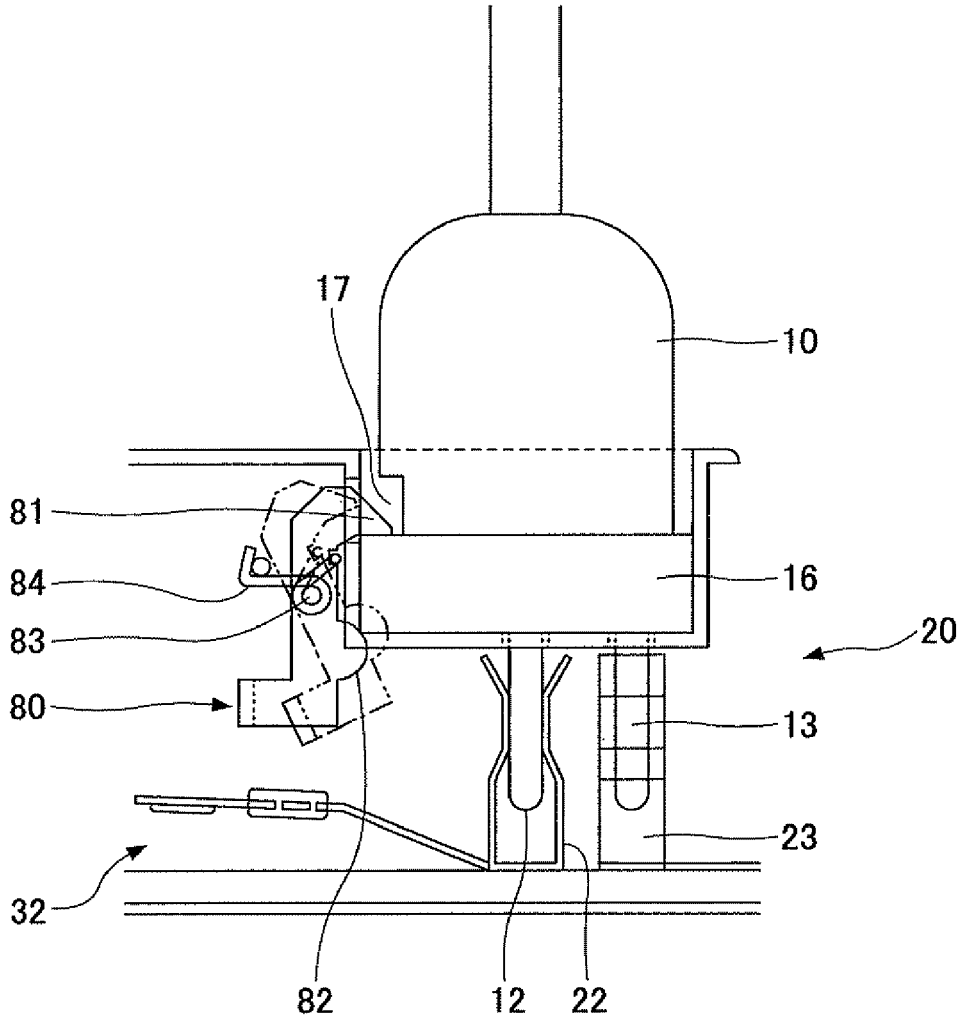
FIG. 4 is a side view, in partial transparency, showing the connectors of the first embodiment in a mated state.

Next, a description will be given of the male connector 10 and the female connector 20 in the mated state, by referring to FIG. 4. FIG. 4 is a side view, in partial transparency, showing the connectors 10 and 20 of the first embodiment in the mated state.

In the mated state where the male connector 10 is inserted into the recess 25 of the female connector 20, the power plug terminals 11 and 12 are inserted into and make contact with the corresponding power jack terminals 21 and 22, and the ground plug terminal 13 is inserted into and make contact with the corresponding ground jack terminal 23. In addition, in this mated state, a side surface of the flange 16 of the male connector 10 makes contact with and pushes the circular projection 82 of the releasable lock 80 that is provided in the female connector 20. Due to the pushing force applied on the circular projection 82, the releasable lock 80 pivots about the rotary shaft 83 from a state indicated by a dotted line to a state indicated by a solid line in FIG. 4, and the claw part 81 of the releasable lock 80 locks a portion of the flange 16 where the locking part 17 of the male connector 10 is formed. Accordingly, the locking engagement of the claw part 81 and the flange 16 enables the mated state of the male connector 10 and the female connector 20 to be maintained. In this mated state, the releasable lock 80 is pivotable about the rotary shaft 83, and the male connector 10 may be pulled and removed from the female connector 20. When removing the male connector 10 from the female connector 20, the releasable lock 80 pivots about the rotary shaft 83 by the force of the compression spring 84, so that the releasable lock 80 returns to the original state before the insertion of the male connector 10 into the female connector 20 when the male connector 10 is disconnected from the female connector 20.

In a state where the male connector 10 is not yet completely removed (that is, pulled out completely) from the recess 25 of the female connector 20, the power plug terminals 11 and 12 of the male connector 10 are still in contact with the corresponding power jack terminals 21 and 22 of the female connector 20, and the ground plug terminal 13 of the male connector 10 is still in contact with the corresponding ground jack terminal 23 of the female connector 20. But as will be described later, the moving contact is not connected to the second fixed contact in each of the control switches 31 and 32 (that is, the control switches 31 and 32 are in an open state or an OFF state) by the action of the abutting switch 90, to thereby prevent the power from being supplied from the high-voltage power supply 50 to the power plug terminals 11 and 12 of the male connector 10 via the power jack terminals 21 and 22 of the female connector 20. In other words, the control switches 31 and 32 in the OFF state insulate the power jack terminals 21 and 22 from the power supplied from the high-voltage power supply 50.

Figure 5A:
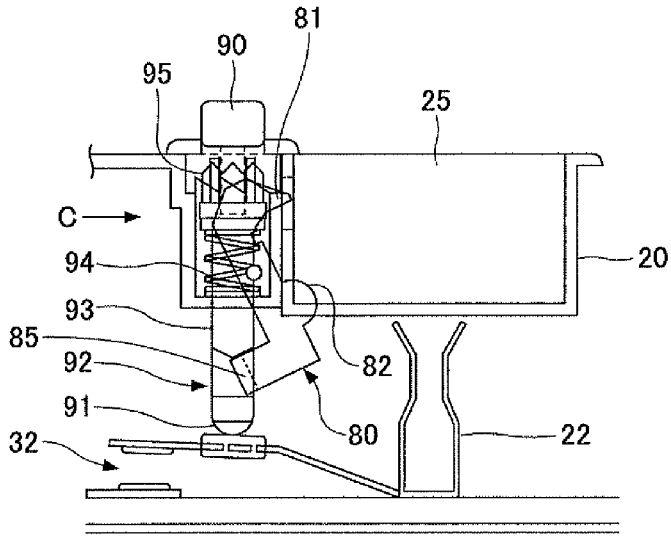
FIGS. 5A, 5B, 5C and 5D are diagrams for explaining an operation of an abutting switch of the female connector in the first embodiment.
Figure 5B:
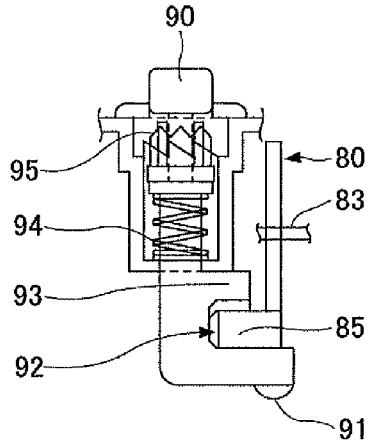
Figure 5C:
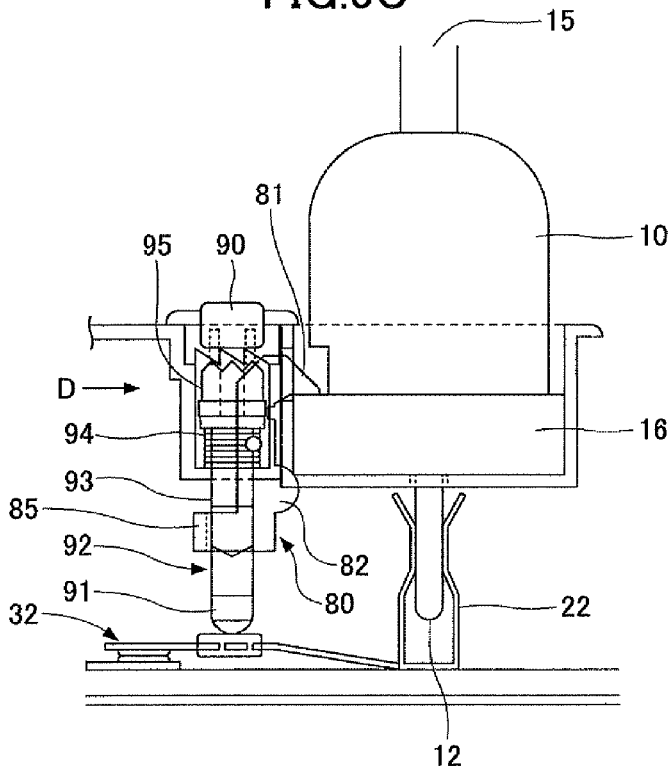
Figure 5D:
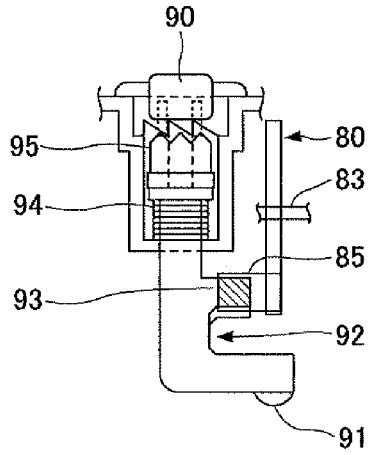

Next, a description will be given of the abutting switch 90 which controls the supply of power from the high-voltage power supply 50, by referring to FIGS. 5A, 5B, 5C and 5D. FIGS. 5A, 5B, 5C and 5D are diagrams for explaining the abutting switch 90 of the female connector 20 in the first embodiment. FIG. 5A is a side view, showing the abutting switch 90 in partial transparency, in a state before the male connector 10 is inserted into the recess 25 of the female connector 20, that is, before the abutting switch 90 is pushed. FIG. 5B is a front view, in partial transparency, showing a portion of the abutting switch 90 viewed in a direction C in FIG. 5A. FIG. 5C is a side view, showing the abutting switch 90 in partial transparency, in the mated state where the male connector 10 and the female connector 20 are connected and the abutting switch 90 is pushed. FIG. 5D is a front view, in partial transparency, showing a portion of the abutting switch 90 viewed in the direction C in FIG. 5C.

The abutting switch 90 may be formed by a push-button switch or the like. The abutting switch 90 is maintained in an ON state when pushed once, and returns to the original OFF state when pushed again.

As shown in FIGS. 5A and 5B, the abutting switch 90 has a contact pushing shaft 91, a cutout 92 adapted to allow passing of the stopper 85 of the releasable lock 80, a stopper holding part 93 for holding the stopper 85 of the releasable lock 80 in a state where the abutting switch 90 is pushed, a compression spring 94 for returning the abutting switch 90 from the pushed state to the original state, and a knock rotation part 95. The knock rotation part 95 rotates every time the abutting switch 90 is pushed, and alternately puts the abutting switch 90 to the ON state and the OFF state. In the OFF state where the abutting switch 90 is not pushed, the moving contact does not make contact with the second contact in each of the control switches 31 and 32, that is, the control switches are in the open state or the OFF state.

The control switches 31 and 32, the abutting switch 90, the contact pushing shaft 91, the cutout 92, the stopper holding part 93, the compression spring 94, and the knock rotation part 95 form a switching mechanism which is linked to the locking mechanism described above. The switching mechanism in an ON state supplies the power from the high-voltage power supply 50 to the power jack terminals 21 and 22 of the female connector 20, but this ON state is only permitted in a state where the locking mechanism is locking the male connector 10 in the mated state with respect to the female connector 20. The switching mechanism makes a transition to the ON state when the abutting switch 90 is pushed manually by a person. The switching mechanism in an OFF state insulates the power jack terminals 21 and 22 of the female connector 20 from the power from the high-voltage power supply 50. Further, the locking mechanism is prohibited from releasing the lock with respect to the male connector 10 (in the mated state) in the ON state of the switching mechanism.

When the male connector 10 is inserted into the recess 25 of the female connector 20 as shown in FIG. 4, the circular projection 81 of the releasable lock 80 is pushed by the flange 16 of the male connector 10, and the releasable lock 80 pivots about the rotary shaft 83. By this pivoting action of the releasable lock 80, the stopper 85 can pass through the cutout 92 of the abutting switch 90.

Thereafter, as shown in FIGS. 5C and 5D, the abutting switch 90 is pushed in the mated state where the male connector 10 is inserted into the recess 25 of the female connector 20, in order to put the abutting switch 90 to an ON state from an OFF state. By pushing the abutting switch 90, the pushing force causes the moving contact to make contact with the second contact in each of the control switches 31 and 32. In other words, the control switches 31 and 32 are put into a closed state or an ON state. As a result, the power from the high-voltage power supply 50 is supplied to the power jack terminals 21 and 22 of the female connector 20, and is transmitted to the corresponding power plug terminals 11 and 12 of the male connector 10.

On the other hand, when the male connector 10 and the female connector 20 are mated, the releasable lock 80 pivots and the claw part 81 locks the flange 16 of the male connector 10 as described above in conjunction with FIG. 4. In this state, even if the abutting switch 90 is pushed, the stopper 85 of the releasable lock 80 is held by the stopper holding part 93 of the abutting switch 90 and the releasable lock 80 cannot pivot about the rotary shaft 83. In this state where the releasable lock 80 is prevented from pivoting, the claw part 81 of the releasable lock 80 in the female connector 20 locks the flange 16 of the male connector 10, and the male connector 10 cannot be removed from the female connector 20. Consequently, the mated state of the male connector 10 and the female connector 20 is maintained.

However, when the abutting switch 90 is pushed again in this embodiment, the knock rotation part 95 rotates, and the abutting switch 90 returns to the original OFF state by the force of the compression spring 94. In the OFF state of the abutting switch 90, the stopper 85 of the releasable lock 80 is movable, and consequently, the male connector 10 is removable (that is, disconnectable) from the female connector 20.

Figure 6:
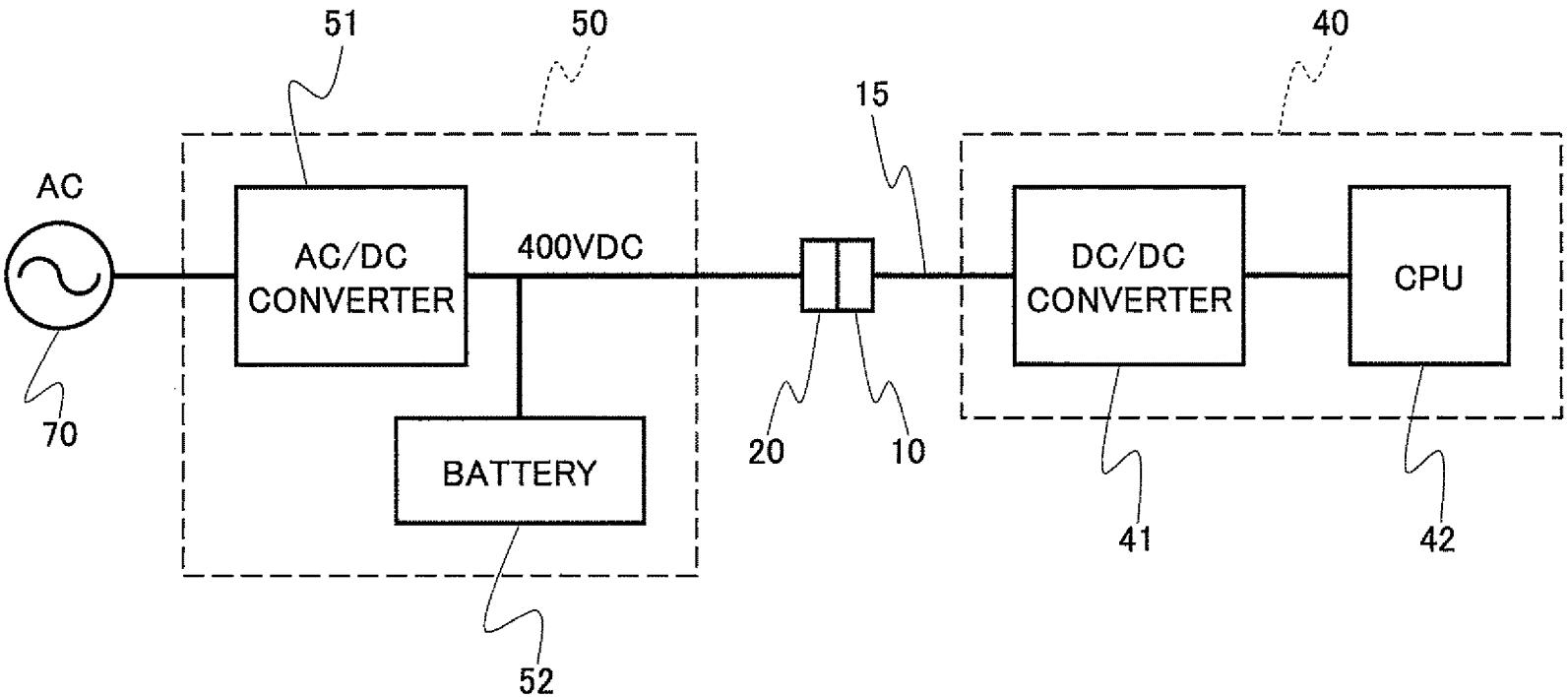
FIG. 6 is a diagram showing a structure of a power supply system using the connectors of the first embodiment.

Next, a description will be given of a structure of a power supply system using the connectors of this embodiment, by referring to FIG. 6. FIG. 6 is a diagram showing the structure of the power supply system using the connectors 10 and 20 of the first embodiment.

The power supply system shown in FIG. 6 inputs the power from a commercial power supply 70, such as an AC voltage of 100V or 200V, to an AC-to-DC (AC/DC) converter 51 of the high-voltage power supply 50. The AC/DC converter 51 converts the AC voltage of 100 V or 200 V into a DC voltage of 400 V, for example. The high-voltage power supply 50 is provided with a backup battery 52 for copying with a power failure situation or the like. This backup battery 52 stores the DC power output of the AC/DC converter 51. The high-voltage power supply 50 is connected to the female connector 20 of this embodiment via a cable. Hence, the power from the high-voltage power supply 50, that is, the DC voltage of 400 V, is supplied from the female connector 20.

On the other hand, the male connector 10 of this embodiment mates with the female connector 20. The male connector 10 is connected to the information processing apparatus 40 via the power cable 15, in order to supply the power from the high-voltage power supply 50 to the information processing apparatus 40. In this example, the information processing apparatus 40 includes a DC-to-DC (DC/DC) converter 41 and a Central Processing Unit (CPU) 42. The DC/DC converter 41 converts the DC voltage of 400 V into a relatively low DC voltage with which electronic parts, including the CPU 42, is able to perform an operation.

The power loss of the power supply system shown in FIG. 6 is small, because the conversion of the AC power from the commercial power supply 70 into the DC power is only carried out once. In addition, when transmitting the high DC voltage of 400 V, it is unnecessary to make the cross sectional size of the power cable relatively large. Furthermore, the DC voltage output from the AC/DC converter 51 of the high-voltage power supply 40 can be supplied to the backup battery 52 to charge (that is, accumulate charge in) the backup battery 52. The provision of the backup battery 52 which may be charged by the DC power output of the AC/DC converter 51 enables continued operation using the power supply system even if a power failure of the commercial power supply 70 occurs.

Figure 7:
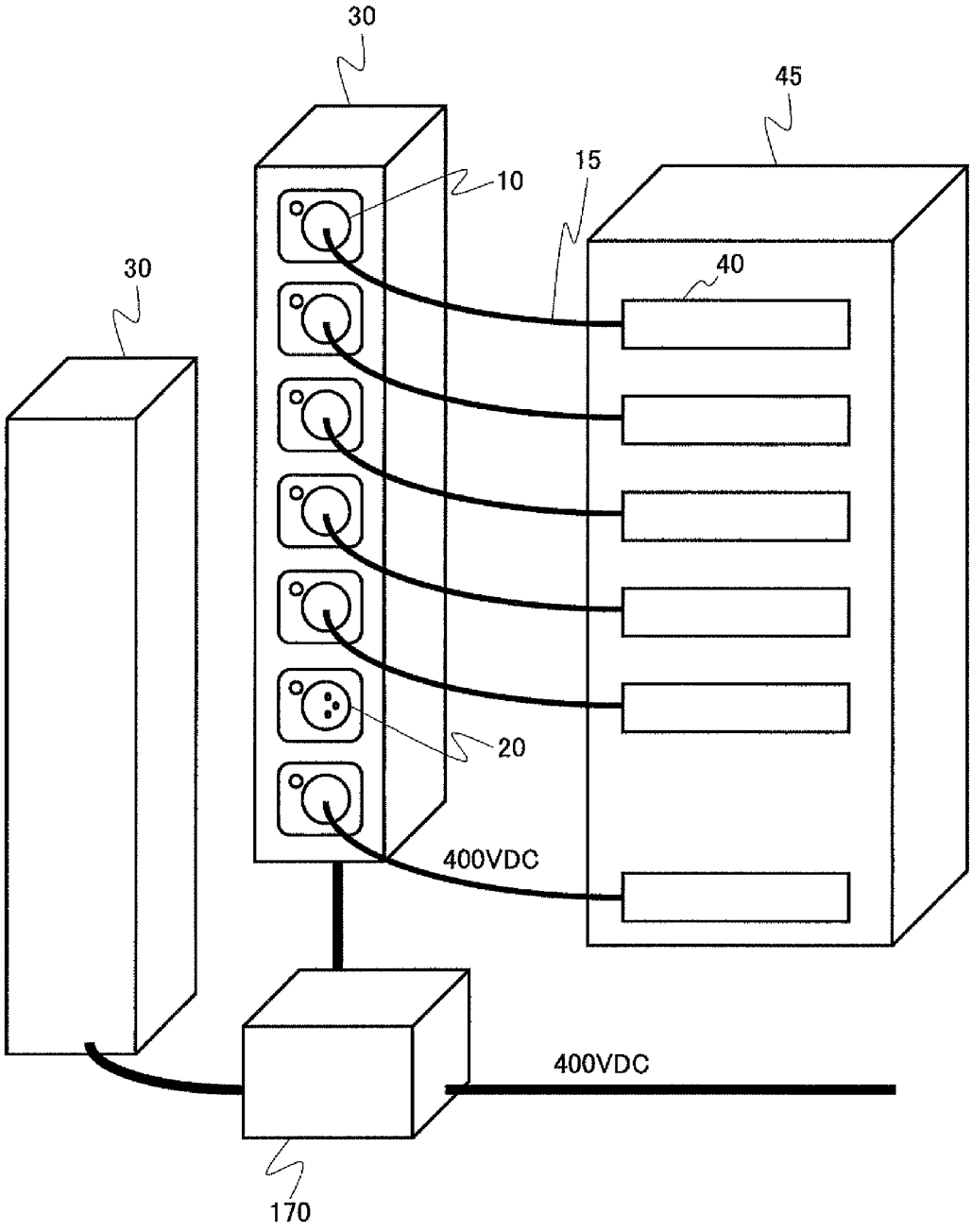
FIG. 7 is a perspective view showing a Power Distribution Unit (PDU) using the connectors of the first embodiment.

Next, a description will be given of a Power Distribution Unit (PDU) using the connectors of this embodiment, by referring to FIG. 7. FIG. 7 is a perspective view showing the PDU using the connectors 10 and 20 of the first embodiment.

The DC voltage of 400 V which is supplied from the high-voltage power supply 50 shown in FIG. 6 is input to a distribution board 170 shown in FIG. 7. The distribution board 170 distributes the power to each of a plurality of PDUs 30. Each PDU 30 has a plurality of female connectors 20, and is capable of supplying power, namely, the DC voltage of 400 V, via each female connector 20. On the other hand, a server rack 45 accommodates a plurality of information processing apparatuses 40, such as servers and computers, and each information processing apparatus 40 is connected via a power cable 15 to a male connector 10 for receiving power. By mating the male connector 10 to the female connector 20 of the PDU 30, the DC voltage of 400 V may be supplied to the information processing apparatus 40 via the male connector 10 and the power cable 15.

Next, a description will be given of a second embodiment of the present invention. In this second embodiment, the male connector is provided with a pin for pivoting the releasable lock.

Figure 8A:
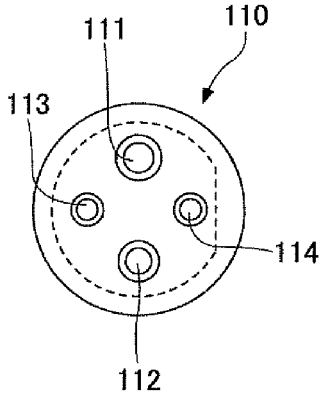
FIGS. 8A, 8B, 8C and 8D are diagrams showing a structure of a male connector of a second embodiment of the present invention.
Figure 8B:
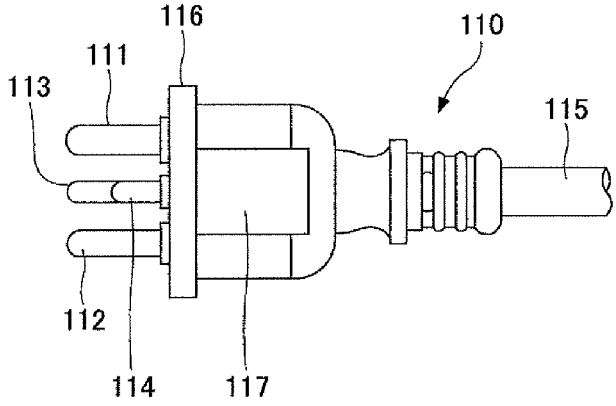

FIGS. 8A, 8B, 8C and 8D are diagrams showing a structure of a male connector of the second embodiment of the present invention. FIG. 8A shows a bottom view of a male connector 110 of this embodiment, FIG. 8B shows a front view of the male connector 110, and FIG. 5C shows a top view of the male connector 110.

In this embodiment, the male connector 110 has flange 116. Power plug terminals 111 and 112, a ground plug terminal 113, and a pin 114 are provided on the flange 116. The pin 114 extends parallel to the plug terminals 111 through 113. A main body of the male connector 110 is connected to a power cable 115, and the main body has a locking part 117. A portion of the main body is removed along a direction in which the male connector 110 is inserted with respect to a female connector 120, in order to form the locking part 117. As will be described later, the flange 116 has a function of turning a releasable lock 180 of the female connector 120 in order to lock the male connector 110 and the female connector 120 in a mated state, and a function of improving insulation with respect to the human body when a person inserts the male connector 110 into the female connector 120 or removes the male connector 110 from the female connector 120.

Figure 8C:
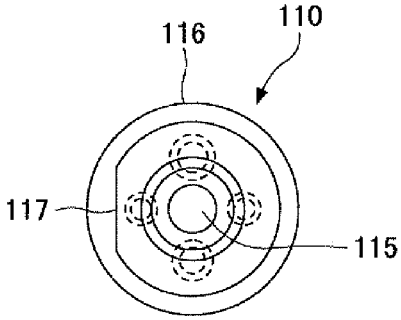
Figure 8D:
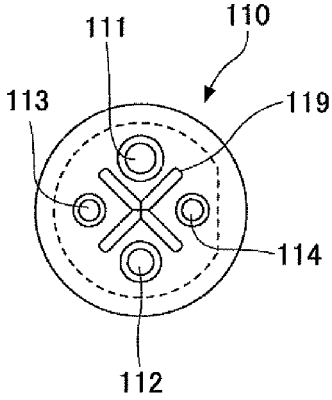

The structure of the male connector 110 in this embodiment is not limited to that shown in FIGS. 8A through 8C, and may have a modified structure shown in FIG. 8D, for example. In the modified structure shown in FIG. 8D, a partition 119 is provided on the flange 116 in order to partition the regions in which the terminals 111 through 113 and the pin 114 are provided. The partition 119 enables the sliding distance of the terminals 111 through 113 to increase with respect to the corresponding terminals 121 through 123 of the female connector 120, while positively preventing unwanted short-circuiting of adjacent terminals. In this particular example, the partition 119 is formed by X-shaped walls in the top view. However, the partition 119 may be formed by grooves in the flange 116, and the grooves may also have an X-shape in the top view. In this case, the depth of the grooves forming the partition 119 enables the sliding distance of the terminals 111 through 113 to increase with respect to the corresponding terminals 121 through 123 of the female connector 120, while positively preventing unwanted short-circuiting of adjacent terminals.

In this embodiment, it is assumed for the sake of convenience that the power plug terminals 111 and 112 and the ground plug terminal 113 have a cylindrical shape, however, the plug terminals 111 through 113 may have other suitable shapes, such as a blade shape. Of course, the plug terminals 111 through 113 do not need to have identical shapes, and at least one of the plug terminals 111 through 113 may have a shape different from that of the other two of the plug terminals 111 through 113. In addition, the cross sectional area of the plug terminals 111 and 112 may be different from that of the plug terminal 113. For example, the cross sectional area of the plug terminals 111 and 112 may be larger than that of the plug terminal 113. The different plug shape and/or size can prevent the male connector 110 from being inserted into the female connector 120 in an incorrect orientation.

Figure 9:
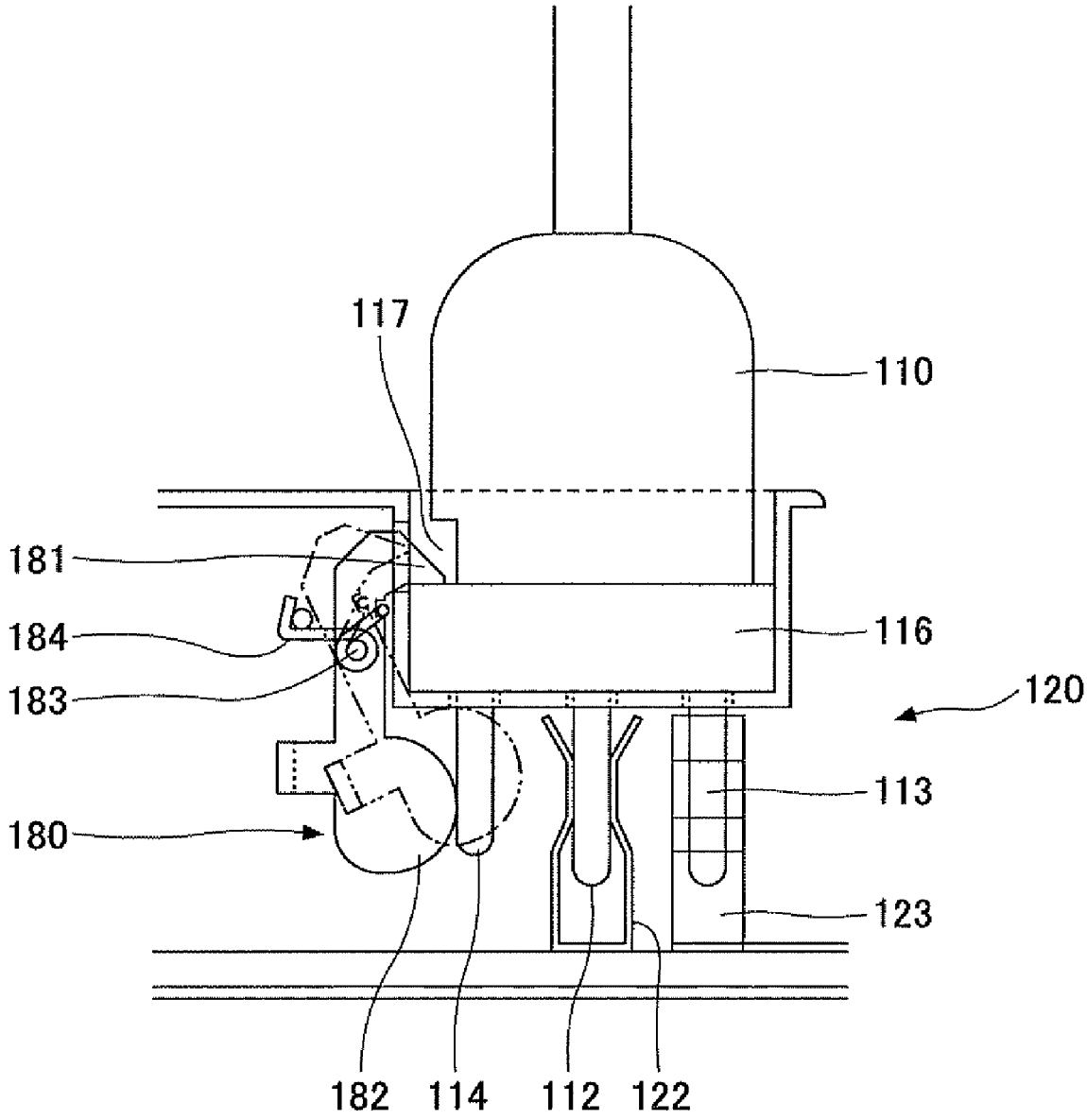
FIG. 9 is a side view, in partial transparency, showing the connectors of the second embodiment in a mated state.

Next, a description will be given of the male connector 110 and the female connector 120 of this embodiment in a mated state, by referring to FIG. 9. FIG. 9 is a side view, in partial transparency, showing the connectors 110 and 120 of the second embodiment in the mated state. In this second embodiment, those parts that are the same as those corresponding parts of the first embodiment are designated by the same reference numerals, and an illustration and description thereof will be omitted.

In the mated state of the male connector 110 and the female connector 120, the plug terminals 111 through 113 of the male connector 110 make contact with the corresponding jack terminals 121 through 123 of the female connector 120. In addition, when mating the male connector 110 and the female connector 120, the pin 114 of the male connector 110 makes contact with and pushes against a circular projection 182 of a releasable lock 180 that is provided in the female connector 120. Hence, the releasable lock 180 pivots about a rotary shaft 183 from a state indicated by a dotted line to a state indicated by a solid line, and a claw part 181 of the releasable lock 180 locks a portion of the flange 116 where the locking part 117 of the male connector 110 is formed. Accordingly, the locking engagement of the claw part 181 and the flange 116 enables the mated state of the male connector 110 and the female connector 120 to be maintained. In this mated state, the releasable lock 180 is pivotable about the rotary shaft 183, and the male connector 110 may be pulled and removed from the female connector 120. When removing the male connector 110 from the female connector 120, the releasable lock 180 pivots about the rotary shaft 183 by the force of a compression spring 184, so that the releasable lock 180 returns to the original state before the insertion of the male connector 110 into the female connector 120 when the male connector 110 is disconnected from the female connector 120.

In a state where the male connector 110 is not yet completely removed (that is, pulled out completely) from the female connector 120, the power plug terminals 111 and 112 of the male connector 110 are still in contact with the corresponding power jack terminals 121 and 122 of the female connector 120, and the ground plug terminal 113 of the male connector 110 is still in contact with the corresponding ground jack terminal 123 of the female connector 120. However, the moving contact is not connected to the second fixed contact in each of the control switches 31 and 32 (not shown) by the action of the abutting switch 90 (not shown), to thereby prevent the power from being supplied from the high-voltage power supply 50 (not shown) to the power plug terminals 111 and 112 of the male connector 110 via the power jack terminals 121 and 122 of the female connector 120.

Except for the mechanisms associated with the pin 114, this embodiment is otherwise basically the same as the first embodiment described above.

The embodiments described above use the combination of the male and female connectors to supply the DC voltage of 400 V, for example. However, the combination of the male and female connectors are suited for supplying any DC voltage, because unlike the AC voltage, the DC voltage does not have a frequency safe to the human body.

From the point of view of preventing undesirable effects on the human body, the DC voltage is normally set to 48 V or lower since it may be regarded that the effects of electric shock on the human body is virtually negligible for DC voltages of 48 V or lower. The effects on the human body are large for DC voltages exceeding 48 V, and it may be regarded dangerous for DC voltages of 200 V or higher.

The male connector, the female connector, and the combination of the male and female connectors according to the embodiments described above can improve the safety by improving the insulation with respect to the human body when a person inserts the male connector into the female connector or removes the male connector 10 from the female connector. The effects of improving the safety are notable for DC voltages exceeding 48 V, and particularly notable for DC voltages of 200 V or higher.

This application claims the benefit of a Japanese Patent Application No. 2008-196923 filed on Jul. 30, 2008, in the Japanese Patent Office, the disclosure of which is hereby incorporated by reference.

Further, the present invention is not limited to these embodiments, but various variations and modifications may be made without departing from the scope of the present invention.

What is claimed is:

1. A female connector for supplying received power, comprising:

a recess configured to receive a male connector;

a plurality of terminals including power terminals for supplying the power;

a locking mechanism configured to lock the male connector that is inserted into the recess in a mated state; and a switching mechanism configured to supply the received power to the power terminals in an ON state and to insulate the power terminals from the received power in an OFF state, wherein the locking mechanism locks the male connector in the mated state in response to insertion of the male connector into the recess so that the insertion and locking of the male connector are achieved in a single operation, and wherein the switching mechanism, in response to the locking performed by the locking mechanism, makes a transition to the ON state only when the locking mechanism is locking the male connector in the mated state.

2. The female connector as claimed in claim 1, wherein:

the locking mechanism includes a projection having a first position and a second position, and a claw part linked to the projection, and the projection in the first position when pushed by the male connector to the second position pivots the claw part in order to lock the male connector in the mated state.

3. The female connector as claimed in claim 2, wherein the locking mechanism further includes a compression spring configured to urge the projection to the first position.

4. The female connector as claimed in claim 2, wherein the projection in the first position prohibits the switching mechanism from making a transition from the OFF state to the ON state.

5. The female connector as claimed in claim 2, wherein the projection projects into the recess in the first position, and the projection is receded from within the recess in the second position.

6. The female connector as claimed in claim 5, wherein the projection in the first position is engaged by a flange of the male connector entering the recess.

7. The female connector as claimed in claim 2, wherein the projection in the first position is engaged by a pin of the male connector entering the recess.

8. The female connector as claimed in claim 1, wherein the locking mechanism is prohibited from releasing the lock with respect to the male connector in the ON state of the switching mechanism.

9. The female connector as claimed in claim 1, wherein the power is supplied in a form of a DC voltage.

10. The female connector as claimed in claim 9, wherein the DC voltage exceeds 48 V.

11. The female connector as claimed in claim 1, wherein the recess receives the male connector inserted in a single direction by the single operation.

12. A combination of a male connector and a female connector, said combination comprising:

a male connector comprising first terminals; and a female connector comprising:

a recess configured to receive the male connector;

a plurality of second terminals including power terminals for supplying received power;

a locking mechanism configured to lock the male connector that is inserted into the recess in a mated state; and a switching mechanism configured to supply the received power to the power terminals in an ON state and to insulate the power terminals from the received power in an OFF state, wherein the locking mechanism locks the male connector in the mated state in response to insertion of the male connector into the recess so that the insertion and locking of the male connector are achieved in a single operation, and wherein the switching mechanism, in response to the locking performed by the locking mechanism, makes a transition to the ON state only when the locking mechanism is locking the male connector in the mated state.

13. The combination as claimed in claim 12, wherein:

the locking mechanism includes a projection having a first position and a second position, and a claw part linked to the projection, and the projection in the first position when pushed by the male connector to the second position pivots the claw part in order to lock the male connector in the mated state.

14. The combination as claimed in claim 13, wherein the locking mechanism further includes a compression spring configured to urge the projection to the first position.

15. The combination as claimed in claim 13, wherein the projection in the first position prohibits the switching mechanism from making a transition from the OFF state to the ON state.

16. The combination as claimed in claim 13, wherein:

the male connector further comprises a pin extending parallel to the first terminals; and the projection in the first position is engaged by the pin of the male connector entering the recess.

17. The combination as claimed in claim 13, wherein the projection projects into the recess in the first position, and the projection is receded from within the recess in the second position.

18. The combination as claimed in claim 17, wherein:

the male connector further comprises a flange having the first terminals; and the projection in the first position is engaged by the flange of the male connector entering the recess.

19. The combination as claimed in claim 12, wherein the locking mechanism is prohibited from releasing the lock with respect to the male connector in the ON state of the switching mechanism.

20. The combination as claimed in claim 12, wherein the power is supplied from the second terminals of the female connector to the first terminals of the male connector in a form of a DC voltage.

21. The combination as claimed in claim 20, wherein the DC voltage exceeds 48 V.

22. The combination as claimed in claim 12, wherein the recess receives the male connector inserted in a single direction by the single operation.

* * * * *